United States Patent [19]

Givati

[11] Patent Number: 4,971,506

[45] Date of Patent: Nov. 20, 1990

[54] VEHICLE PARKING SYSTEM

[75] Inventor: Izhak Givati, Tel Aviv, Israel

[73] Assignee: Shakbar Investments Ltd., Tel-Aviv, Israel

[21] Appl. No.: 238,028

[22] Filed: Aug. 22, 1988

[30] Foreign Application Priority Data

May 6, 1988 [IL] Israel ..... 86295

[51] Int. Cl.[5] ..... B65G 1/04

[52] U.S. Cl. ..... 414/256; 414/232; 414/228; 414/253; 414/231; 414/460; 414/255

[58] Field of Search ..... 414/227, 231, 232, 234, 414/239, 240, 241, 246, 242, 252, 253, 255, 259, 260, 261, 262, 264, 459, 460

[56] References Cited

U.S. PATENT DOCUMENTS

| | | | |
|---|---|---|---|
| 2,605,911 | 8/1952 | Medway . | |
| 2,663,436 | 12/1953 | Bowser . | |
| 2,670,859 | 3/1954 | Zeckendorf et al. | 414/252 X |
| 2,714,456 | 8/1955 | Manaugh . | |
| 2,801,011 | 7/1957 | Overlach et al. | 414/255 |
| 2,904,200 | 9/1959 | Diehl | 414/255 X |
| 2,936,082 | 5/1960 | Alimanestiano . | |
| 2,988,329 | 6/1961 | Sanders | 414/255 X |
| 3,008,590 | 11/1961 | Alimanestiano . | |
| 3,107,016 | 10/1963 | Shutt . | |
| 3,390,791 | 7/1968 | Baldwin et al. . | |
| 3,710,956 | 1/1973 | Meyer et al. | 414/232 X |
| 3,759,409 | 9/1973 | Wenzel et al. | 414/460 |
| 3,817,406 | 6/1974 | Sawada et al. . | |
| 3,840,131 | 10/1974 | Castaldi . | |
| 3,866,767 | 2/1975 | Zollinger et al. . | |
| 4,307,985 | 12/1981 | Desprez et al. | 414/234 X |
| 4,413,942 | 11/1983 | Roth | 414/253 |
| 4,664,580 | 5/1987 | Matoba | 414/228 |
| 4,804,307 | 2/1989 | Motoda | 414/232 X |

FOREIGN PATENT DOCUMENTS

| | | | |
|---|---|---|---|
| 2347806 | 4/1975 | Fed. Rep. of Germany | 414/231 |
| 8603246 | 6/1986 | PCT Int'l Appl. | 414/231 |

*Primary Examiner*—Frank E. Werner

*Attorney, Agent, or Firm*—Benjamin J. Barish

[57] ABSTRACT

A parking system for automotive vehicles, comprises a building structure divided into a ground parking level and at least two upper parking levels, each having a floor and a ceiling defining between them one or more lines of parking spaces extending longitudinally of the respective level. The floor and ceiling of each level are spaced from each other a distance which is greater than twice the height of the vehicles to be parked in the respective level, to define a lower zone of parking spaces for supporting the vehicles, and an upper zone for conveying the vehicles to a selected parking space in the lower zone.

19 Claims, 6 Drawing Sheets

14
ZU
ZL
20
26
23
22
25
24

12
2
4
34
ZU
20
32
ZL
14
10
8
6
82
83
S3
S2
S1

FIG 4
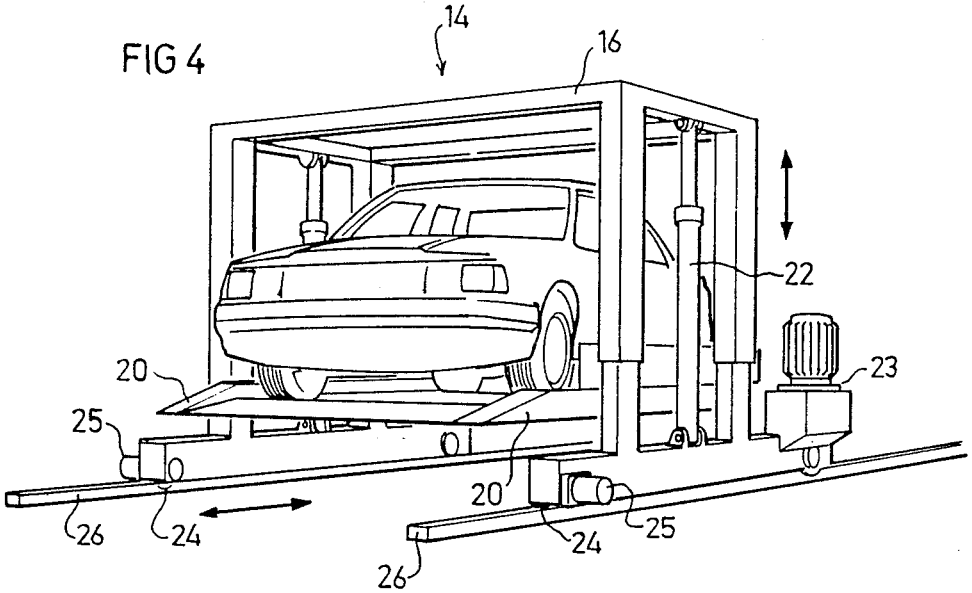
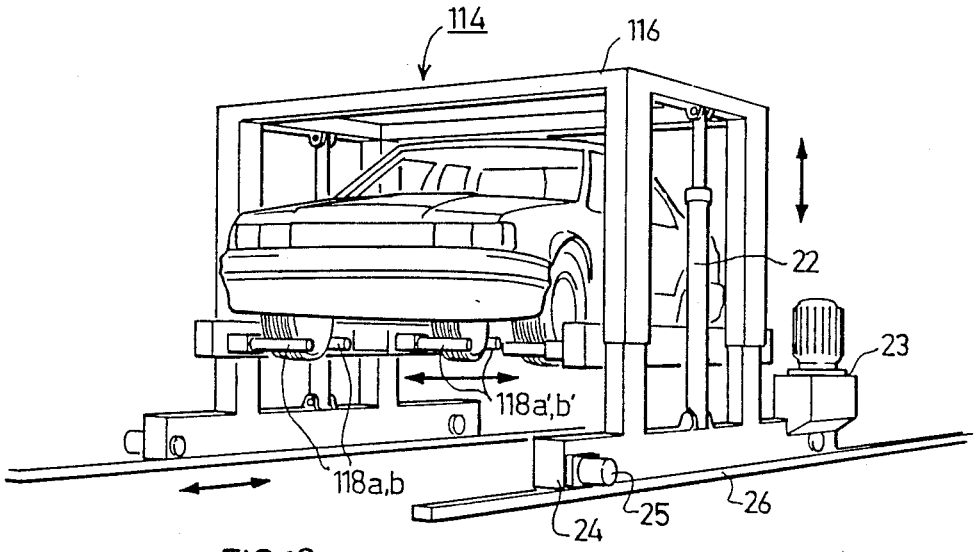
FIG 10

FIG. 5
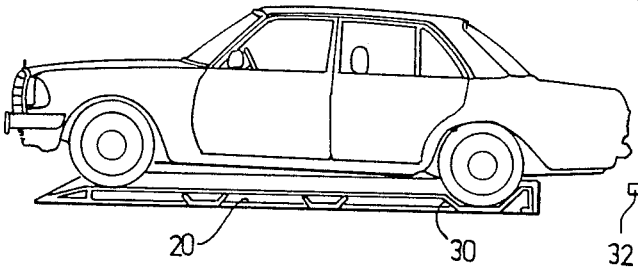
FIG. 6
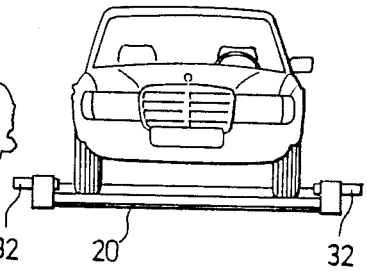
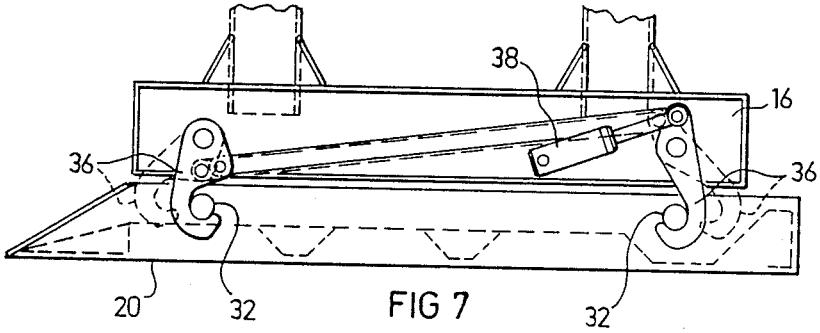
FIG 7
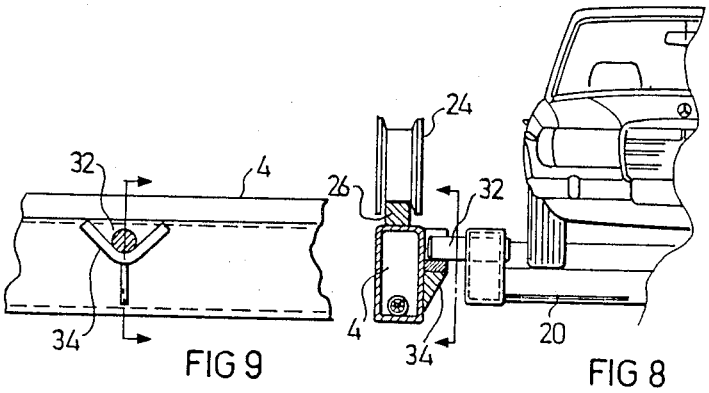
FIG 9
FIG 8

VEHICLE PARKING SYSTEM

BACKGROUND OF THE INVENTION

The present invention relates to a vehicle parking system, and particularly to a multi-level parking building.

The problem of providing parking spaces for automotive vehicles is becoming increasingly serious because of the increase in demand for parking spaces, and the decrease in supply of land available for such parking spaces, particularly in commercial centers or densely-populated areas. Various types of multi-level building structures have been proposed and erected to provide the large number of parking spaces required. Examples of such previously-proposed parking systems are described in the following U.S. patents:

Alimanestiano Patent Nos. 2,936,082 and 3,008,590 describe arrangements for increasing the capacity of outdoor parking lots by providing a level of storage spaces above the vehicles parked on the ground;

Medway Patent No. 2,605,911 describes a parking arrangement including an aisle provided laterally for each line of parking spaces;

Bowser Patent No. 2,663,436 describes a mult-level arrangement including a central elevator shaft providing access to a parking stall on its two opposite sides in each level;

Manaugh Patent 2,714,456 describes an arrangement wherein craneways (17, 18) are provided between each pair of structural units (14, 15, 16), each structural unit being divided into multiple tiers of parking stalls (41–47), and each craneway accommodating an elevator mechanism (E-1, E-2) adapted to convey an auto vertically and horizontally;

Shutt Patent No. 3,107,016 describes an arrangement including two vertical tiers (11, 12) of parking stalls on opposite sides of a vertical well (12) housing the vertical and horizontal lift which conveys each vehicle to a selected stall;

Baldwin et al. Patent No. 3,390,791 describes an arrangement including two aisles of pallets defining a closed circuit with at least one empty space, to enable an empty pallet in either aisle to be aligned with the loading station;

Sawada et al. Patent Pat. 3,817,406 describes a non-random-access storage system including a loading crane 2 for lifting the article (6) on a dolly (5) to the selected level and then moving the dolly on the tracks at the selected level, which dolly travels along the track until it senses the preceding article, whereupon it unloads the article;

Castaldi Patent No. 3,840,131 describes a two-dimensional random access storage system for file boxes and the like, and including a two-dimensional matrix of storage compartments for receiving a file box (10) and accessible by a carriage movable vertically by a platform (26) and horizontally by wheels (32, 32');

Roth et al. Patent No. 4,413,942 describes a lift construction for parking vehicles including a telescoping transport device;

and Matoba Patent No. 4,664,580 describes a parking garage including four inner pillars (12–16) defining a square inner core space (17) functioning as an elevator shaft, and 8 outer pillars (18–22) producing an array of parking stalls of cruciform shape, each accessible from the inner elevator shaft.

As a rule such parking systems are expensive to construct, or provide a relatively limited number of parking spaces, or require relatively large land spaces, so that the cost for each parking space is relatively high.

An object of the present invention is to provide a new type parking system which enables the cost for parking spaces to be significantly reduced.

BRIEF SUMMARY OF THE INVENTION

The present invention provides a parking system particularly useful to enable almost any available plot of land to be utilized for accommodating a large number of automotive vehicles, and comprises a building structure constructed of a plurality of structural elements to define at least one vertical column of parking levels constituted of a ground parking level and at least two upper parking levels at vertically increasing elevations. Each of the parking levels has a floor and a ceiling defining between them a line of parking spaces extending horizontally. The floor and ceiling of each of the parking levels are spaced from each other a distance which is greater than twice the height of the vehicles to be parked in the respective level, to define a lower zone of parking spaces for supporting the vehicles, and an upper zone for conveying the vehicles to a selected parking space in the lower zone. Each of the vertical columns includes a separate entrance/exit for the respective vertical column, and a separate vertical conveyor adjacent the entrance/exit for the respective vertical column to convey a vehicle entering or leaving the respective vertical column to or from a selected one of the upper parking levels in the respective column. The parking system further includes horizontal conveyor means for each vertical column communicating with the vertical conveyor of the respective vertical column for conveying each vehicle, when conveyed to its selective level, upwardly to the upper zone of the selected level, then horizontally to a selected parking space, and then downwardly into the selected parking space in the lower zone of the respective parking level.

According to a further feature of the invention as described below, the structural elements include a plurality of modular units joined to each other. Each modular unit is an open, box-like frame structure having a height slightly greater than twice the height of the vehicle to be parked in the respective level, a length slightly greater than the length of the vehicle to be parked in the respective level, and a width slightly wider than the vehicle to be parked in the respective level.

According to a still further feature in the described preferred embodiment, the horizontal conveyor means for each vertical column comprises a separate conveyor unit for each level of the respective vertical column. Each of the conveyor units includes a vehicle supporting device for supporting a vehicle thereon, vertical drive means for raising and lowering the vehicle thereon, vertical drive means for raising and lowering the vehicle supporting device from the lower zone to the upper zone of the respective parking level, and horizontal drive means for driving the vehicle supporting device horizontally in the longitudinal direction through the upper zone of the respective parking level to a selected parking space in the lower zone of the respective line of parking spaces.

The building structure may include only a single vertical column of parking levels, or a plurality of vertical columns of parking levels in side-by-side relationship, with each vertical column being provided with its own separate entrance/exit and separate vertical conveyor. Preferably, each level of each vertical column is provided with its own separate horizontal conveyor unit.

The invention thus enables almost any available plot of land to be used for providing a large number of parking spaces. The plot of land may be wide enough to accommodate only a single line of vehicles at each level, e.g., along the side of an existing building. Thus, a relatively small space at one side of an existing building can be used for producing a relatively large number of parking spaces. The novel parking system accommodates itself not only to the shape and dimensions of the available plot of land, but also to its topography, particularly in changes in elevation. Thus, if an irregularly-shaped plot of land is available, the vertical columns could vary in length according to the configuration of the land plot, and could also vary in height according to the changes in its elevation. The modular units, if used, may resemble unitized containers, such as are employed in ship and truck transport of goods but of an open frame structure, to provide many of the advantages of this technique in transporting goods. Thus, they may be constructed at a central location and erected very quickly and conveniently on any plot of land that may become available, even on a temporary basis, and subsequently disassembled and erected at another location where parking facilities may be needed. Such units can be erected according to the size and configuration of the available land plot, and can be stacked one on top of the other to provide as many levels of parking spaces as desired. By providing each parking level with a lower zone for parking the vehicles and an upper zone for conveying the vehicles to a selected parking space in the lower zone, the need for ramps is obviated.

Several embodiments of the invention are described below for purposes of example.

In one described embodiment, the conveyor means comprises a conveyor unit having a vehicle supporting device which includes a pallet for receiving one or more wheels of the vehicle, a pair of pins projecting from the opposite sides of the pallet at each of its opposite ends, and a pair of hooks carried by the conveyor unit attachable to and detachable from the pins.

In a second described embodiment, the conveyor means includes a vehicle supporting device comprising a pair of bars for each wheel of the vehicle and actuatable either to a retracted, inoperative position, or to a projected, operative position disposed on opposite sides of the respective vehicle wheels so as to define an open frame for supporting the vehicle.

Further features and advantages of the invention will be apparent from the description below.

BRIEF DESCRIPTION OF THE DRAWINGS

The invention is herein described, by way of example only, with reference to the accompanying drawings, wherein:

FIG. 4 is a three-dimensional view illustrating one form of conveyor unit that may be used in the building structure;

FIGS. 5 and 6 are side and end elevational views, respectively, illustrating the vehicle supporting device in the conveyor unit of FIG. 4;

FIGS. 7, 8 and 9 are fragmentary views more particularly illustrating the manner of attaching the vehicle supporting device of FIGS. 5 and 6 to the conveyor unit of FIG. 4;

FIG. 10 is a three-dimensional view illustrating another vehicle supporting device which may be used in the conveyor unit of FIGS. 4;

DESCRIPTION OF PREFERRED EMBODIMENTS

Figures 1, 2:
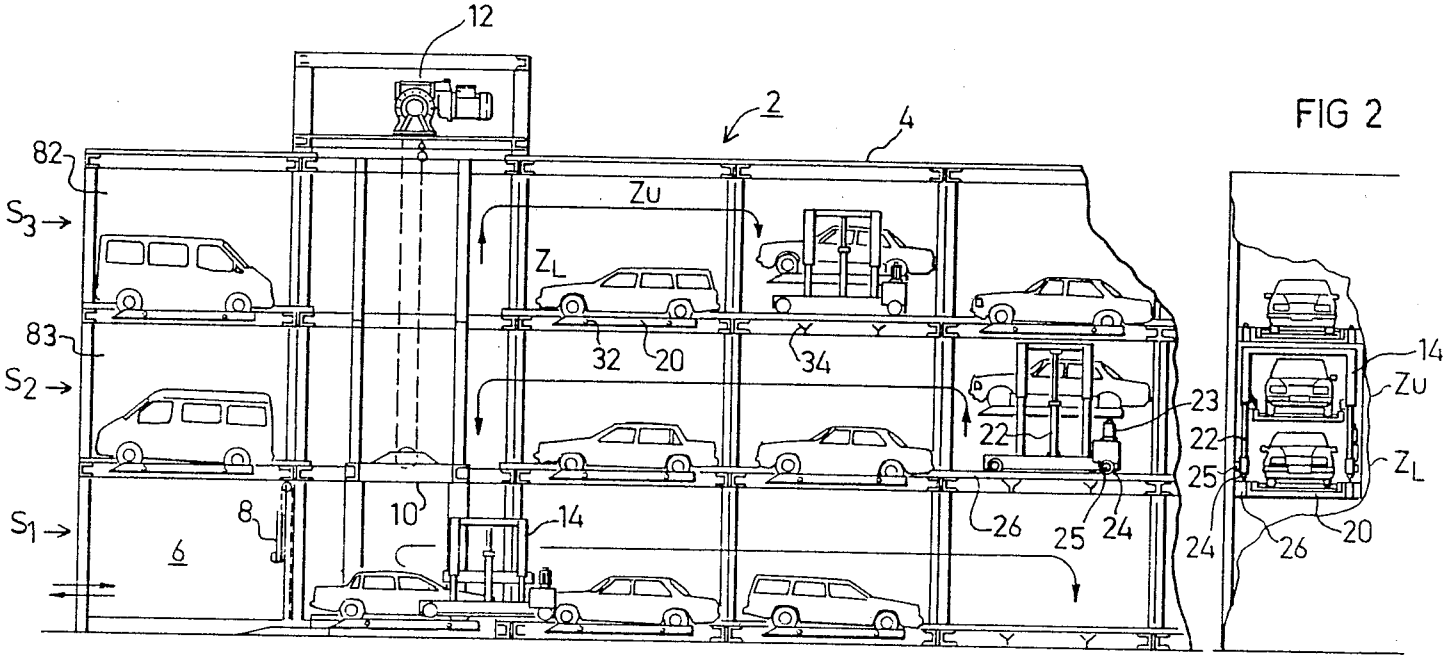
FIG. 1 is a side elevational view, partly broken away, illustrating one form of parking system constructed in accordance with the present invention.
FIG. 2 is an end elevational view, partly broken away, of the system illustrated in FIG. 1.
Figure 13:
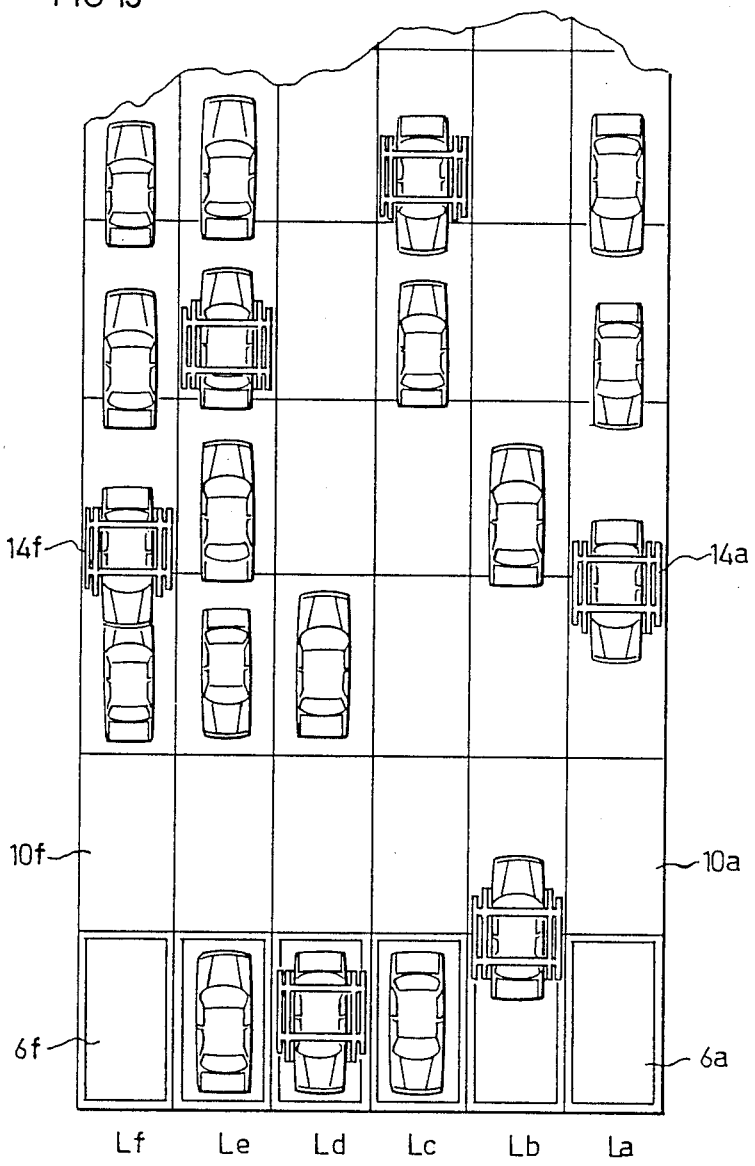
FIG. 13 is a plan view illustrating one of the higher parking levels in the parking system of FIG. 1.

The parking system illustrated in FIGS. 1 and 2 comprises a building structure, generally designated 2, constructed of a plurality of modular units 4 (FIG. 3) joined to each other to provide a plurality of parking levels or storeys (e.g., levels $S_1$, $S_2$, $S_3$, FIG. 1) arranged vertically at increasing elevations. Each level has a floor and a ceiling defining between them at least one line of parking spaces, preferably a plurality of lines in side-by-side relationship as shown in FIG. 13, with each line extending longitudinally of the respective level.

Figure 3A:
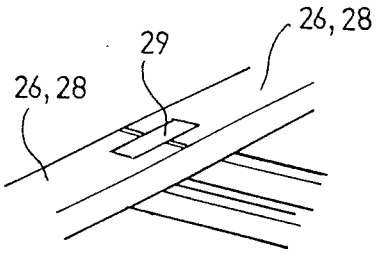
FIG. 3*a* is a fragmentary view illustrating the connection of the rails of two modular units.
Figure 3:
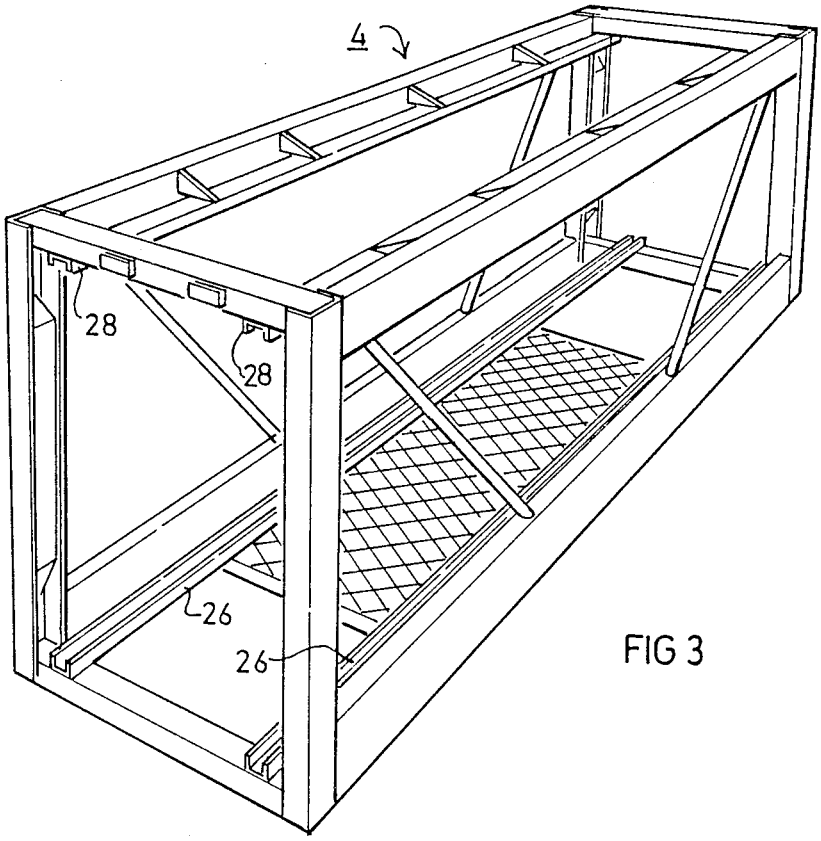
FIG. 3 is a three-dimensional view illustrating one form of modular unit which may be used for erecting the building structure of FIGS. 1 and 2.

Each modular unit 4, as illustrated in FIG. 3, is in the form of an open, box-like frame structure of steel beams. The height of each level is greater than twice the height of the vehicle to be parked in the respective level. The modular unit has a height equal to the height of the respective level, i.e., slightly greater than twice the height of each vehicle to be parked, so that the number of levels of available parking spaces provided by the erected building structure equals the number of modular units stacked one on top of the other. In addition, each modular unit 4 has a width slightly larger than that of a single vehicle, and a length also slightly larger than that of a single vehicle, so that each modular unit accommodates but a single vehicle. Accordingly, the number of modular units joined together in a straight line, and the number of lines of such units in each level, can be varied according to the number of parking spaces desired and the size of the lot or space available.

Preferably, the modular units 4 are joined together by bolts so as to enable them to be readily assembled into a multi-level parking structure whenever a lot or other space (e.g., next to an existing building) is available, and to be disassembled, when the lot or other space is no longer available, for transport to another location. As one example, the height of each modular unit 4 may be four meters (157.5 inches), its width may be 3.5 meters (118 inches), and its length may be 6.050 meters (240 inches).

The building structure illustrated in FIG. 1 includes an entrance/exit 6 for each of the lines of parking spaces. Entrance/exit 6 is normally closed by a gate 8, which is automatically opened upon the entry (or exit) of a vehicle. The entering vehicle is conveyed by conveyor means to a selected space. Such conveyor means comprises an elevator 10 driven by an elevator drive 12 for conveying the vehicle upwardly to the selected level of the respective line, and a conveyor unit 14 which is movable in and out of elevator 10 and serves all the levels of the respective line of parking spaces. A conveyor unit 14, provided at each level for each line, lifts the vehicle to the upper zone $Z_U$ of the respective line of modular units, conveys it horizontally in the longitudinal direction via zone $Z_U$ to the location of a selected parking space within the lower zone $Z_L$ of the respective line, and then moves the vehicle downwardly into the selected parking space of the lower zone $Z_L$.

Figures 11, 12:
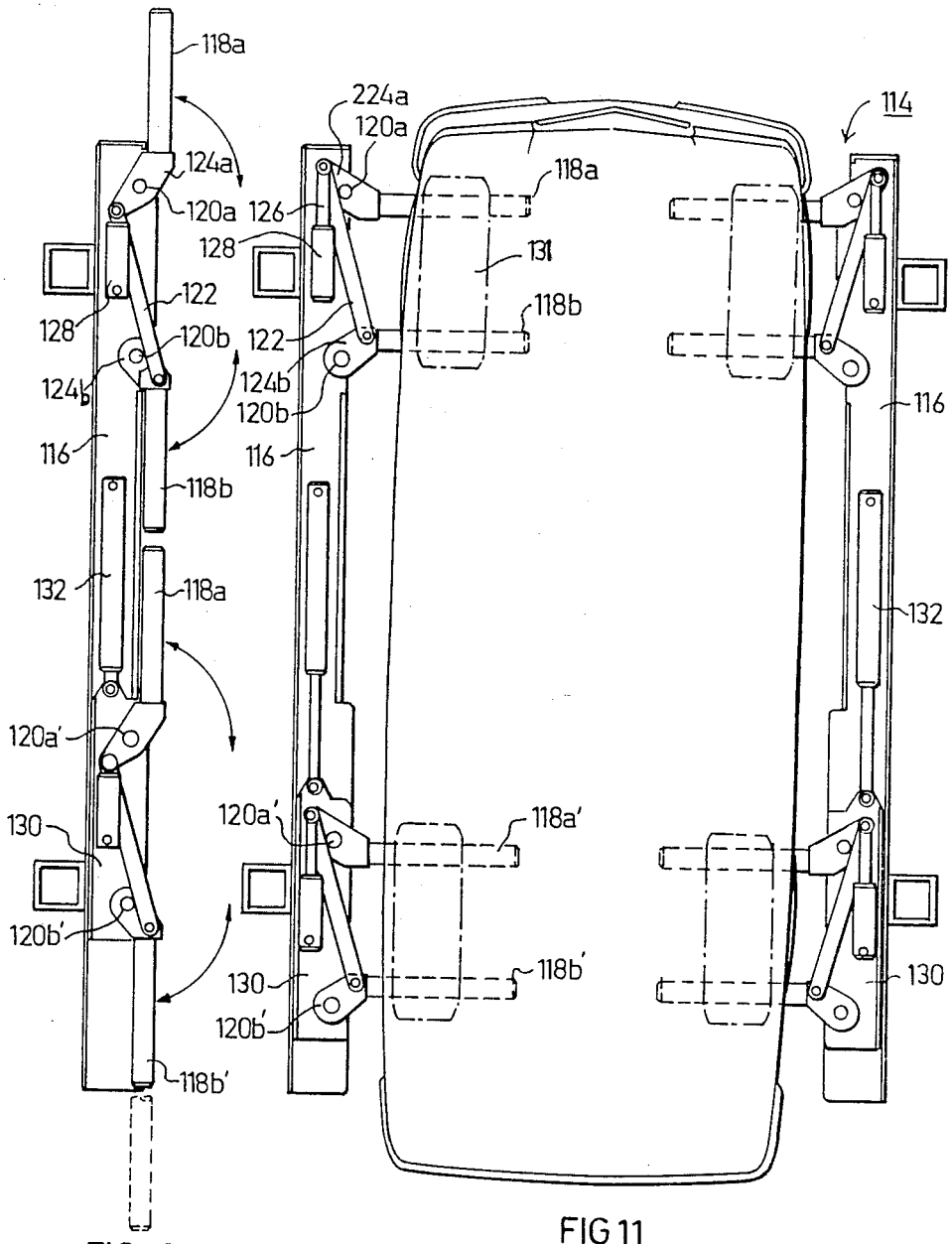
FIGS. 11 and 12 are plan and side elevational views, respectively, illustrating the manner of operation of the vehicle supporting device of FIG. 10.

FIGS. 4–9 illustrate one form of conveyor unit 14 which may be used for this purpose; FIGS. 10–12 illustrate a second form.

Conveyor unit 14 illustrated in FIGS. 4–9 comprises a frame 16 carrying a vehicle supporting device in the form of a pallet 20 for supporting the vehicle; a vertical drive in the form of a ram 22 driven by a hydraulic motor 23 for raising and lowering pallet 20 and the vehicle supported thereon; and a horizontal drive for driving the pallet and the vehicle thereon horizontally in the longitudinal direction through the upper zone $Z_U$ (FIG. 2) to the selected parking space in the selected line of parking spaces. The horizontal drive comprises wheels 24 (FIGS. 4, 8) driven by hydraulic motors 25 (FIG. 4) carried by the frame 16 of the conveyor unit 14 and driven over rails 26 carried at the lower end of the modular units 4. Preferably, the upper ends of the modular units 4 are also provided with rails 28, as shown in FIG. 3, in order to strengthen the modular unit and to enable it to be oriented with either and serving as the bottom. The rails of adjacent modular units are bridged by bridging elements 29 as shown in FIG. 3*a*.

As shown particularly in FIG. 5, pallet 20 is formed with a pair of recesses 30 at its rear end, for receiving the rear wheels of the vehicle. The pallet is further formed with a pair of pins 32 projecting from the opposite sides of the pallet at each of its opposite ends. These pins are received within U-shaped seats 34 (FIGS. 8 and 9) fixed to the frame of the modular units 4 when the pallet is in a parking space, and are locked to the conveyor unit by hooks 36 (FIG. 7) actuated by actuators 38 carried by the conveyor unit frame 16 when the pallet is conveyed.

The operation of the parking system illustrated in FIGS. 1–9 will be apparent from the above description. Thus, assuming gate 8 for the respective multi-level line of parking spaces is open (indicating that line in all the levels is not yet completely filled), the vehicle is driven by its driver through the entrance 6 onto the pallet 20 in the elevator 10. The conveyance of the vehicle to a selected parking space at a selected level for that line may thereafter be computer-controlled, e.g., by a magnetic card introduced by the vehicle driver.

In the previous operation, a pallet 20 had been conveyed to the elevator 10, so that the entering vehicle is received on that pallet.

The elevator 10 is actuated to raise the pallet 20 and the vehicle thereon to the level of the parking space assigned to that vehicle. At the selected level, the conveyor unit 14 for that level is actuated to enter the elevator and to overlie the pallet and the vehicle thereon. Vertical ram 22 of the conveyor unit is lowered, and its hooks 36 are actuated to enclose pins 32 of the pallet so as to firmly attach the pallet to the conveyor unit.

The vertical rams 22 of the conveyor unit are then actuated to raise the pallet 20, and the vehicle carried thereby, to the upper zone $Z_U$ of the respective level. The traction wheels 24 of the conveyor unit 14 are actuated to drive the conveyor unit and the vehicle carried thereby through this upper zone $Z_U$ in the longitudinal direction to the selected parking space. Upon reaching the selected parking space, rams 22 of the conveyor unit 14 are driven to lower the pallet and the vehicle into the selected parking space at the lower zone $Z_L$, and then the hooks 36 are actuated to detach the pallet from the conveyor unit.

Thereafter, the conveyor unit 14 places another empty pallet on elevator 10 ready for receiving another vehicle to be parked. To remove a parked vehicle, the same procedure is followed but in reverse.

FIGS. 10–12 illustrate a conveyor unit, therein designated 114, having a frame 116 equipped with another type of vehicle supporting device for conveying the vehicle from the elevator (10, FIG. 1) to the selected parking space at the respective level. Thus, the vehicle supporting device illustrated in FIGS. 10–12 comprises a pair of bars 118 for each wheel of the vehicle and actuatable either to a retracted, inoperative position (FIG. 12), or to a projected, operative position (FIGS. 10, 11) on opposite sides of the respective vehicle wheel. Since the vehicle includes four wheels, there would be four pairs of such supporting bars 118, the two bars of each pair being designated as 118*a*, 118*b*.

The two supporting bars 118*a*, 118*b* of each pair are pivotally mounted to the conveyor unit frame 116 and are coupled together by a coupling bar 122. Coupling bar 122 is pivotally coupled to an extension 124*a* of supporting bar 118*a* on the outer side of its pivot 120*a*, and is pivotally coupled to an extension 124*b* of supporting bar 118*b* on the inner side of its pivot 120*b*. Coupling bar 122 is in turn driven by a piston rod 126 movable within a cylinder 128, such that when the piston is in its innermost position within the cylinder (FIG. 12), the two supporting bars 118*a*, 118b are pivoted to their retracted, inoperative positions substantially parallel to conveyor unit frame 116; however, when piston 126 is actuated to its extended position (FIG. 11), it pivots the two supporting bars 118*a*, 118*b* to their projected, operative positions, extending substantially perpendicularly to frame 116 of the conveyor unit 114, on opposite sides of the respective vehicle wheel 131. The four pairs of supporting bars 118*a*, 118*b*, are actuated simultaneously via their respective cylinders 128.

The pivot points 120*a*, 120*b* of the two pairs of bars 118 cooperable with the front end of the vehicle are in fixed position with respect to the frame 116 of the conveyor unit 114. However, the pivot points 120*a*', 120*b*' of the supporting bars 118*a*', 118*b*', cooperable with the rear end of the vehicle, are carried by a carriage 130 which is adjustable by a cylinder 132 along the length of the conveyor unit frame 116, so as to position the two pairs of supporting bars 118*a*', 118*b*', at the proper position according to the wheel base length of the vehicle to be supported by these bars.

When the vehicle has been received on the elevator 10 (FIG. 1) and moved thereby to the selected level of parking spaces, the conveyor unit 114 at that level is moved onto the elevator to overlie the vehicle, while the supporting bars 118 are in their retracted positions as illustrated in FIG. 12. The conveyor unit is aligned with the vehicle on the elevator such that the front supporting bars underlie the two front wheels. Cylinder 132 is then actuated to align the rear supporting bars 118 with the two rear wheels. The supporting bars are then pivoted to their projected, operative positions, as illustrated in FIGS. 10 and 11, by the actuation of cylinders 128 so that the bars of each pair engage the opposite sides of each wheel.

The conveyor unit 114 is then actuated to lift the vehicle to the upper zone $Z_U$ (FIG. 2) of the line of parking spaces at that level. It is then driven longitudinally along the respective line to the location of the selected parking space, and then lowered to lower the vehicle into that parking space in the lower zone $Z_L$. When this has been completed, the supporting bars 118*a*, 118*b* are actuated to their retracted, inoperative positions, as illustrated in FIG. 12, permitting the conveyor unit to rise again and to return via the upper zone $Z_U$ to the beginning of the line of parking spaces at that level preparatory for receiving another vehicle to be parked.

As indicated earlier, in FIG. 1 there is a separate entrance 6 for each vertical column of parking spaces in the building structure. This is more particularly illustrated in the plan view of FIG. 13, wherein it will be seen that there are six vertical columns of parking spaces La-Lf, each vertical column being provided with a separate entrance, 6*a*–6*f*. Each vertical column would also be provided with a separate elevator 10*a*–10*f*, while there would be a separate conveyor unit 14*a*–14*f* for each vertical column and each level of parking spaces.

The entrance-exit unit 6 in FIGS. 1 and 13 may also be constructed as a modular unit to be included with the other modular units when erecting the building structure. Preferably, one additional modular unit is provided for each line and for each level of parking spaces, as shown at 82 and 83 in FIG. 1, which modular units are also serviced by the common elevator 10 of that line and by the conveyor units 14 of the respective levels. These additional parking spaces 82, 83 may be used for larger vehicles, such as trucks or busses, projecting into the upper zone $Z_U$, since there are no parking spaces on the other sides of these units that have to be accessible to the conveyor unit via the upper zones.

It will be appreciated that many other variations of the invention may be made. For example, the parking structure may be erected alongside an existing building and may include only one line of parking spaces, e.g., to use otherwise "dead space" adjacent the building. Also, a single conveyor unit may be provided for all levels, and/or for all lines. Further, other lift arrangements may be made, for example a hydraulic scissors lift, for raising the vehicle to the required level. Also, other horizontal conveyor arrangements may be used, for example a monorail supported from the top of the respective level. Many other variations, modifications and applications of the invention may be made.

What is claimed is:

1. A parking system particularly useful to enable almost any available plot of land to be utilized for providing a large number of parking spaces for automotive vehicles, comprising:

a building structure constructed of a plurality of structural elements to define at least one vertical column of parking levels constituted of a ground parking level and at least two upper parking levels at vertically increasing elevations;

each of said parking levels having a floor and a ceiling defining between them a line of parking spaces extending horizontally;

the floor and ceiling of each of said parking levels being spaced from each other a distance which is greater than twice the height of the vehicles to be parked in the respective level, to define a lower zone of parking spaces for supporting the vehicles, and an upper zone for conveying the vehicles to a selected parking space in the lower zone;

each of said vertical columns including a separate entrance/exit for the respective vertical column, and a separate vertical conveyor adjacent the entrance/exit for the respective vertical column to convey a vehicle entering or leaving the respective vertical column to or from a selected one of said upper parking levels in the respective column;

and horizontal conveyor means for each vertical column communicating with the vertical conveyor of the respective vertical column for conveying each vehicle, when conveyed to its selective level, upwardly to the upper zone of the selected level, then horizontally to a selected parking space, and then downwardly into the selected parking space in the lower zone of the respective parking level;

said horizontal conveyor means for the respective vertical column comprising a separate conveyor unit for each level of the respective vertical column, each of said conveyor units including a vehicle supporting device for supporting a vehicle thereon, vertical drive means for raising and lowering said vehicle supporting device from the lower zone to the upper zone of the respective parking level, and horizontal drive means for driving said vehicle supporting device horizontally in the longitudinal direction through said upper zone of the respective parking level to a selected parking space in the lower zone of the respective line of parking spaces.

2. The parking system according to claim 1, wherein each of said parking levels includes a pair of tracks at the lower end of the lower zone of the respective level and extending longitudinally therethrough; said horizontal drive means including wheels driven along said tracks while said vehicle supporting device is raised by said vertical drive means such that the vehicle supporting device and the vehicle supported thereby are driven through the upper zone of the selected parking level to the selected parking space in the lower zone.

3. The parking system according to claim 2, wherein said vehicle supporting device comprises a pallet having a recess for receiving a pair of the wheels of the vehicle to be supported thereon, and means for attaching and detaching said pallet with respect to the conveyor unit.

4. The parking system according to claim 3, wherein said attaching and detaching means comprises: a pair of pins projecting from the opposite sides of the pallet at each of its opposite ends, a pair of hooks carried by said conveyor unit, and an actuator carried by said conveyor unit for actuating said hooks to their attaching or detaching positions with respect to said pins.

5. The parking system according to claim 3, wherein said vertical drive means comprises a platform for receiving said pallet, and a pair of hydraulically driven rams on opposite sides of said platform for driving said platform in the vertical direction.

6. The parking system according to claim 2, wherein said horizontal drive means comprises a plurality of hydraulically driven wheels carried by said conveyor unit and rollable along rails carried by said building structure.

7. The parking system according to claim 2, wherein said vehicle supporting device comprises a pair of bars for each wheel of the vehicle and actuatable either to a retracted, inoperative position, or to a projected, operative position on opposite sides of the respective vehicle wheel, and drive means for actuating said bars.

8. The parking system according to claim 7, wherein said bars are pivotally mounted to the conveyor unit, and said drive means includes a hydraulic motor for pivoting each pair of bars.

9. The parking system according to claim 1, wherein said plurality of structural elements are modular units joined to each other, each modular unit being an open, box-like frame structure having a height slightly greater than twice the height of the vehicle to be parked in the respective level, a length slightly greater than the length of the vehicle to be parked in the respective level, and a width slightly wider than the vehicle to be parked in the respective level.

10. The parking system according to claim 1, wherein said building structure includes a plurality of said vertical columns of parking levels in side-by-side relationship, each vertical column being provided with its own separate entrance exit and separate vertical conveyor, each level of each vertical column being provided with its own separate horizontal conveyor unit.

11. A parking system particularly useful to enable almost any available plot of land to be utilized for providing a large number of parking spaces for automotive vehicles, comprising:

a building structure constructed of a plurality of structural elements to define at least one vertical column of parking levels constituted of a ground parking level and at least two upper parking levels at vertically increasing elevations;

each of said parking levels having a floor and a ceiling defining between them a line of parking spaces extending horizontally to accommodate vehicles in end-to-end relationship;

the floor and ceiling of each of said parking levels being spaced from each other a distance which is slightly greater than twice the height of the vehicles to be parked in the respective level, to define a lower zone of parking spaces for supporting the vehicles, and an upper zone for conveying the vehicles to a selected parking space in the lower zone;

each of said vertical columns including a separate entrance/exit for the respective vertical column, and a separate vertical conveyor adjacent the entrance/exit for the respective vertical column to convey a vehicle entering or leaving the respective vertical column to or from a selected one of said upper parking levels in the respective column;

and horizontal conveyor means for each vertical column communicating with the vertical conveyor of the respective vertical column for conveying each vehicle, when conveyed to its selective level, upwardly to the upper zone of the selected level, then horizontally to a selected parking space, and then downwardly into the selected parking space in the lower zone of the respective parking level;

said structural elements including a plurality of modular units joined to each other, each modular unit being an open, box-like frame structure having a height slightly greater than twice the height of the vehicle to be parked in the respective level, a length slightly greater than the length of the vehicle to be parked in the respective level, and a width slightly wider than the vehicle to be parked in the respective level.

12. The parking system according to claim 11, wherein said horizontal conveyor means for respective vertical column comprises a separate conveyor unit for each level of the respective vertical column, each of said conveyor units including a vehicle supporting device for supporting a vehicle thereon, vertical drive means for raising and lowering said vehicle supporting device from the lower zone to the upper zone of the respective parking level, and horizontal drive means for driving said vehicle supporting device horizontally in the longitudinal direction through said upper zone of the respective parking level to a selected parking space in the lower zone of the respective line of parking spaces.

13. The parking system according to claim 12, wherein said building structure includes a plurality of said vertical columns of parking levels in side-by-side relationship, each vertical column being provided with its own separate entrance exit and separate vertical conveyor, each level of each vertical column being provided with its own separate horizontal conveyor unit.

14. The parking system according to claim 13, wherein each of said parking levels includes a pair of tracks at the lower end of the lower zone of the respective level and extending longitudinally therethrough; said horizontal drive means including wheels driven along said tracks while said vehicle supporting device is raised by said vertical drive means such that the vehicle supporting device and the vehicle supported thereby are driven through the upper zone of the selected parking level to the selected parking space in the lower zone.

15. The parking system according to claim 14, wherein said vehicle supporting device comprises a pallet having a recess for receiving a pair of the wheels of the vehicle to be supported thereon, and means for attaching and detaching said pallet with respect to the conveyor unit.

16. The parking system according to claim 15, wherein said attaching and detaching means comprises: a pair of pins projecting from the opposite sides of the pallet at each of its opposite ends, a pair of hooks carried by said conveyor unit, and an actuator carried by said conveyor unit for actuating said hooks to their attaching or detaching positions with respect to said pins.

17. The parking system according to claim 14, wherein said vehicle supporting device comprises a pair of bars for each wheel of the vehicle and actuatable either to a retracted, inoperative position, or to a projected, operative position on opposite sides of the respective vehicle wheel, and drive means for actuating said bars.

18. The parking system particularly useful to enable almost any available plot of land to be utilized for providing a large number of parking spaces for automotive vehicles, comprising:

a building structure constructed of a plurality of structural elements to define at least one vertical column of parking levels constituted of a ground parking level and at least two upper parking levels at vertically increasing elevations;

each of said parking levels having a floor and a ceiling defining between them a line of parking spaces extending horizontally;

the floor and ceiling of each of said parking levels being spaced from each other a distance which is greater than twice the height of the vehicles to be parked in the respective level, to define a lower zone of parking spaces for supporting the vehicles, and an upper zone for conveying the vehicles to a selected parking space in the lower zone;

each of said vertical columns including a separate entrance/exit for the respective vertical column, and a separate vertical conveyor adjacent the entrance/exit for the respective vertical column to convey a vehicle entering or leaving the respective vertical column to or from a selected one of said upper parking levels in the respective column;

and horizontal conveyor means for each vertical column communicating with the vertical conveyor of the respective vertical column for conveying each vehicle, when conveyed to its selective level, upwardly to the upper zone of the selected level, then horizontally to a selected parking space, and then downwardly into the selected parking space in the lower zone of the respective parking level;

said horizontal conveyor means for the respective vertical column comprises a separate conveyor unit for each level of the respective vertical column, each of said conveyor units including a vehicle supporting device for supporting a vehicle thereon, vertical drive means for raising and lowering said vehicle supporting device from the lower zone to the upper zone of the respective parking level, and horizontal drive means for driving said vehicle supporting device horizontally in the longitudinal direction through said upper zone of the respective parking level to a selected parking space in the lower zone of the respective line of parking spaces;

said vehicle supporting device comprising a pair of bars for each wheel of the vehicle and actuatable either to a retracted, inoperative position, or to a projected, operative position on opposite sides of the respective vehicle wheel, and drive means for actuating said bars.

19. The parking system according to claim 18, wherein said plurality of structural elements are modular units joined to each other, each modular unit being an open, box-like frame structure having a height slightly greater than twice the height of the vehicle to be parked in the respective level, a length slightly greater than the length of the vehicle to be parked in the respective level, and a width slightly wider than the vehicle to be parked in the respective level.

* * * * *